US005549497A

United States Patent [19]

Johnson et al.

[11] Patent Number: 5,549,497

[45] Date of Patent: Aug. 27, 1996

[54] TOY ROCKET WITH VELOCITY DEPENDENT CHUTE RELEASE

[75] Inventors: Lonnie G. Johnson, Smyrna; John Applewhite, Atlanta, both of Ga.

[73] Assignee: Johnson Research Development Company, Inc., Smyrna, Ga.

[21] Appl. No.: 413,840

[22] Filed: Mar. 30, 1995

Related U.S. Application Data

[63] Continuation-in-part of Ser. No. 165,647, Dec. 8, 1993, Pat. No. 5,407,375.

[51] Int. Cl.[6] ..... A63H 33/20

[52] U.S. Cl. ..... 446/52; 446/429; 446/50

[58] Field of Search ..... 446/49–54, 486, 446/429

[56] References Cited

U.S. PATENT DOCUMENTS

| | | | |
|---|---|---|---|
| D. 158,700 | 5/1950 | Weldon | 446/50 |
| 1,938,931 | 12/1933 | Newman . | |
| 2,023,124 | 12/1935 | Dickover | 446/52 |
| 3,086,317 | 4/1963 | Quercetti | 446/52 |
| 3,218,755 | 11/1965 | Quercetti | 446/52 |
| 3,415,010 | 12/1968 | Belz | 446/52 |
| 3,822,502 | 7/1974 | Belz | 446/52 |
| 4,038,776 | 8/1977 | Filipeli | 446/52 |
| 4,356,662 | 11/1982 | Starsser et al. | 446/52 |
| 4,840,598 | 6/1989 | Schuetz | 446/49 |

FOREIGN PATENT DOCUMENTS

| | | | |
|---|---|---|---|
| 2151146 | 7/1985 | United Kingdom | 446/50 |

*Primary Examiner*—Robert A. Hafer
*Assistant Examiner*—Jeffrey D. Carlson
*Attorney, Agent, or Firm*—Kennedy & Kennedy

[57] ABSTRACT

A rocket (100) is disclosed having a body (101) with a bay (102) therein and a hatch (109) which is movable between a bay opened position and a bay closed position by a spring biased hinge (110). The hatch is pivotally coupled to a nose section (104) by a spring biased hinge (11). The hatch is configured to be engaged and disengaged with a catch (118) mounted to the rocket body. With the initial forward movement of the launched rocket the inertia and/or the force of the wind upon the nose section causes the disengagement of the catch whereby the continued movement of the rocket creates a wind upon the nose section which maintains the hatch in its bay closed position. However, as the rocket reaches its apogee the biasing force of the spring biased hinge (110) overcomes the force of the wind upon the nose section so as to pivot the nose cone so as to disengage the hatch for parachute release

35 Claims, 7 Drawing Sheets

TOY ROCKET WITH VELOCITY DEPENDENT CHUTE RELEASE

REFERENCE TO RELATED APPLICATION

This is a continuation-in-part of application Ser. No. 165,647 filed Dec. 8, 1993 now U.S. Pat. No. 5,407,375.

TECHNICAL FIELD OF THE INVENTION

The present invention relates generally to toys and hobby items and more particular to toy and model rockets having deployable parachutes.

BACKGROUND OF THE INVENTION

For decades, toy rockets have been popular playthings for children of all ages. Such rockets have been made available in all shapes and sizes and many models have been provided with their own propellant, such as pressurized water, pressurized air, or the like. The popularity of toy rockets has even extended to adolescent and adult hobbies in the form of model rockets propelled by solid fuel rocket engines. As a matter of fact, model rocket enthusiasts often spend countless hours constructing model rockets that are large and extremely realistic. Such model rockets typically require a substantial financial investment and can be extremely valuable items for their owners.

Most toy rockets that have been the playthings of children are designed to be launched by one of various means into the air for flight. Rarely, however, have toy rockets been provided with deployable parachutes. Thus, once launched, toy rockets simply follow a trajectory up and then back down to the ground where they impact the earth. Since toy rockets are sturdy and follow relatively low altitude trajectories, their impact with the ground rarely causes damage and they are simply retrieved and launched again.

One type of toy rocket that functions in this way is commonly known as the "Nerf®" rocket. Nerf rockets usually have an elongated cylindrical fuselage that is made of a foam rubber material and that has fins affixed to and extending outwardly from the tail of the rocket. In use, nerf rockets, like many other toy rockets, are propelled from a launcher by means of compressed air, whereupon they follow natural trajectories up and back to the earth.

In contrast to toy rockets, model rockets that are propelled by solid fuel rocket engines commonly are provided with parachutes that are deployed during flight of the rocket to ease the rocket gently back to the earth when its engines are spent. A parachute is desirable for model rockets because these rockets typically are heavier and more fragile than toy rockets and are propelled to much higher altitudes. Accordingly, if these model rockets are allowed to fall naturally back to earth, they can easily be destroyed upon impact with the ground. This is a particularly acute problem with large expensive model rockets, which sometimes include parachutes for each stage as well as redundant parachutes for more expensive portions of the rocket.

In model rockets, the parachute usually is folded and stowed in the nose-cone section of the rocket during flight. For deployment of the parachute, the nose-cone typically is ejected by means of an explosive charge that is activated as the rocket's engines burn out. With the nose-cone thus ejected, the parachute can unfold and deploy for easing the rocket body back to earth.

While such methods of deploying parachutes from model rockets have been relatively successful in the past, they nevertheless have been plagued With numerous problems and shortcomings inherent in their respective designs. For example, the explosive charge that ejects the nose-cone and deploys the chute usually is triggered by the burning engine of the model rocket. Ideally, it is desirable that the explosive charge occur after the engine has burned out. However, such accurate timing has proved elusive such that chute deployment sometimes occurs while the main engine is still burning or occurs after the rocket has reached apogee and is falling back to earth. In addition, the explosive charges that deploy the chutes must be replaced after each flight, which is tedious and time consuming and can become expensive after numerous flights. Also, it is not uncommon that the explosive charge designed to deploy the parachute fails to fire, whereupon a potentially expensive model rocket plummets back to earth and is destroyed.

As mentioned above, unlike model rockets, most toy rockets are not provided with parachutes. This is because toy rockets usually are inexpensive and rugged enough to withstand and impact with the earth. Further, there has previously been no convenient method of deploying a parachute from a toy rocket since there is no burning engine that can be used to trigger a chute deployment charge. Nevertheless, parachutes have been found to be amusing to children who play with toy rockets. It is thus desirable that toy rockets do deploy parachutes at the apogees of their trajectories to ease them back to earth and, in the process, to amuse their owners.

In the past, a few toy rockets have been provided with makeshift parachutes, but the chutes usually are simply wrapped around the body of the rocket and the rocket thrown or propelled into the air. With these types of toy rockets, the chute simply unwinds as the rocket tumbles upwardly through the air and, when fully unwound, deploys to stop the upward movement of the rocket and ease it back to earth. Obviously, such a method of stowing and deploying a parachute is highly undesirable since the rocket tends to tumble as it moves upwardly and does not fly straight through the air. Further, the time at which the chute deploys is completely uncontrollable and the chute rarely deploys at the apogee of the rocket's trajectory, where deployment is most desirable.

Thus, a continuing and heretofore unaddressed need exists for a parachute deployment mechanism for use both with toy and model rockets that does not require an explosive charge for deployment of the chute, does not interfere with the normal upward trajectory of the rocket, that deploys the parachute reliably and accurately at the apogee of the rocket's trajectory regardless of the time during the flight that such apogee occurs, and that is simple and easy to use without requiring replacement of any spent parts between flights. Such a chute deployment mechanism should be equally adaptable to both model and toy rockets and should require no explosive charge for deployment. The mechanism should be reliable and should always deploy the chute when the rocket slows to a low velocity near the apogee of the rocket's trajectory. It is to the provision of such therefore that the present invention is primarily directed.

SUMMARY OF THE INVENTION

In a preferred form of the invention a rocket comprises a body having a bay, a hatch movably mounted to the body for movement between a bay closed and opened positions, biasing means for biasing the hatch towards the bay opened position, and a parachute stowed within the bay. The rocket also has a catch mounted adjacent a forward end of the body and a nose cone coupled to the hatch in latched engagement with the catch with the rocket in a static, prelaunched condition and in unlatched disengagement with the catch in an inertially-launched condition during initial rocket propulsion. With this construction and with initial forward movement of the rocket, the inertia of the nose cone causes it to move to its unlatched condition wherein the velocity of the rocket creates an airstream against the nose cone which maintains the hatch in a closed position by creating a force greater than the biasing force of the biasing means, and wherein the velocity of the rocket below a level sufficient to overcome the biasing force of the biasing means causes the hatch to move towards its bay opened position to release the parachute.

DETAILED DESCRIPTION OF THE PREFERRED EMBODIMENT

Figure 1:
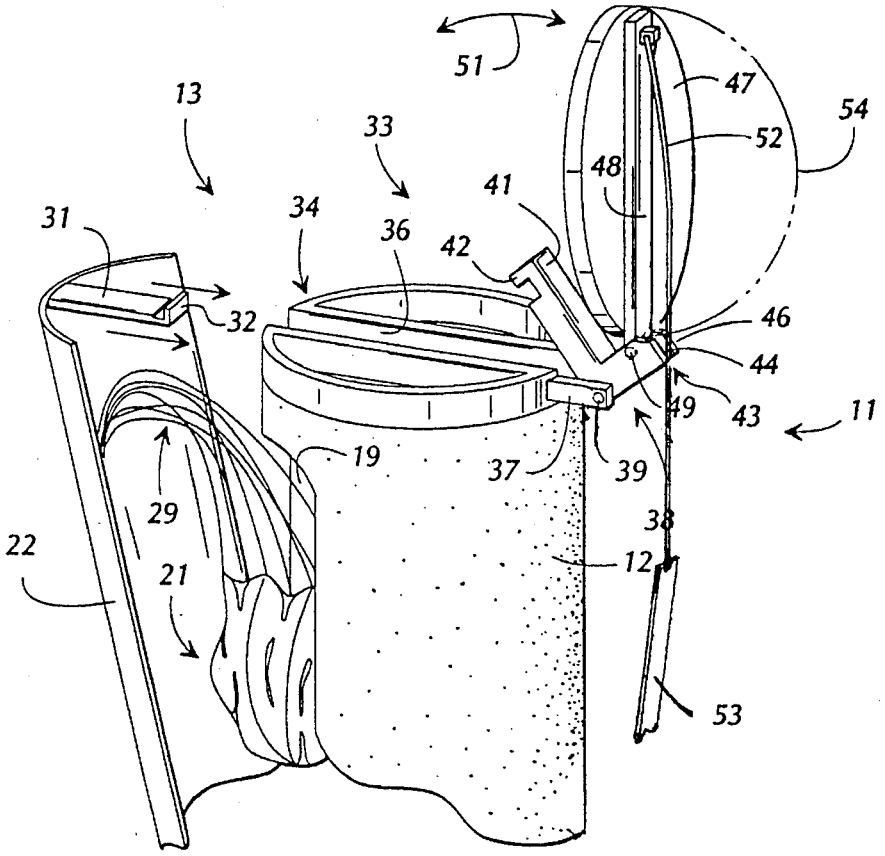
FIG. 1 is a perspective view of the nose-cone section of a toy rocket embodying principals of the present invention in a preferred form.

Referring now to the drawing, in which like numerals refer to like parts throughout the several views, FIG. 1 is a perspective view illustrating the nose-cone section of a toy rocket that embodies principals of this invention in a preferred from. The rocket 11 comprises a generally cylindrical elongated fuselage 12 having a nose section 13 at is top end and a tail section 14 (FIG. 5) at its bottom end. The tail section 14 is provided with a plurality of fins 15 for stabilizing the rocket during flight. Also, in the preferred embodiment, the tail end section 14 of the rocket is provided with a longitudinal bore extending from the tail of the fuselage. The bore is sized to receive the launch tube 17 of a launcher 18, which is designed to propel the rocket into the air by means of a burst of compressed air, as detailed below.

In the preferred embodiment, the fuselage 12 of the rocket 11 is formed from a foam material so that the rocket is relatively light and safe for children. A longitudinally extending cavity 19 is formed along one side of the fuselage 12. Preferably, the cavity 19 is formed integrally with the fuselage during the molding thereof, but could also be machined into the fuselage after molding. The cavity 19 is sized and configured to receive and contain a folded parachute 21 of conventional construction as best illustrated in FIG. 1.

Figure 2:
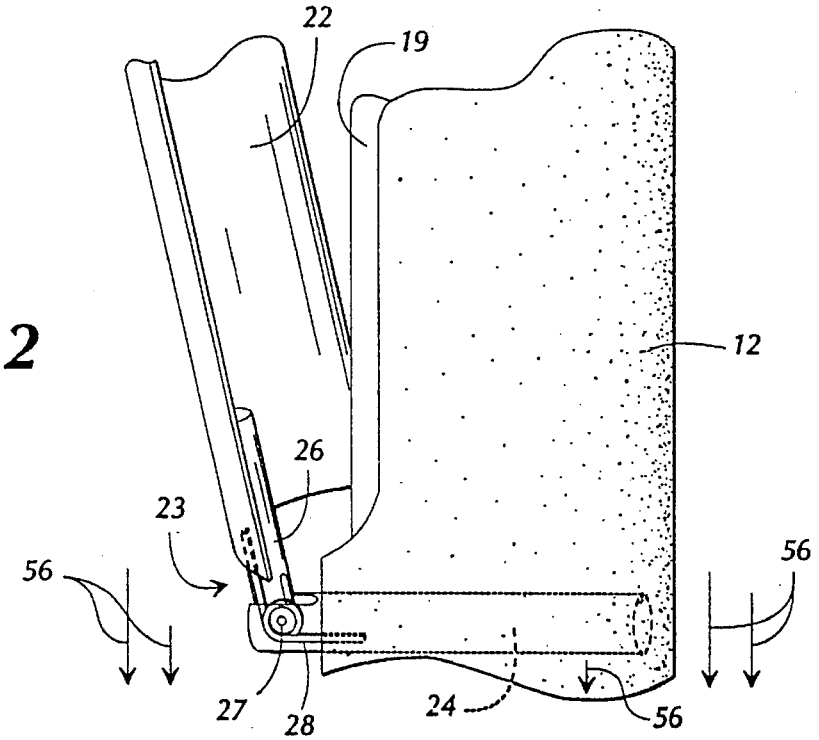
FIG. 2 is a perspective view of a portion of the fuselage of the rocket of FIG. 1 illustrating the hinged attachment of the hatch to the rocket fuselage for opening and closing the cavity.

An elongated curved hatch 22 has a lateral curvature corresponding to the curvature of the rocket fuselage 12 As illustrated in FIG. 2, the hatch 22 is affixed to the fuselage 12 just beneath the lower extent of cavity 19 by means of a spring biased hinge mechanism 23. The hinge mechanism 23 includes a first portion 24 that is embedded within the fuselage 12 and protrudes outwardly therefrom beneath the cavity 19. A second portion 26 of the hinge mechanism is fixed to the hatch 22 and is hingedly coupled to the first portion 24 by means of a hinge pin 27. A small coil spring 28 is disposed about the hinged pin and is arranged to bear with tension against the second portion 26 of the hinge mechanism to spring bias the hatch 22 toward its open position as best illustrated in FIG. 2.

With the just described hatch configuration, it can be seen that the hatch 22 is movable at its hinged attachment between a first position covering and closing the cavity 19 for confining the folded parachute to the cavity and a second position displaced from and opening up the cavity 19 for deployment of the parachute. A plurality of parachute cords 29 (FIG. 1) are each attached at one end to the periphery of the chute and the cords are all fixed at their other end to the interior portion of the hatch 22 near its upper extent. In this way, when the hatch moves from its closed position to its open position, the moving hatch pulls the parachute cords 29 and thus the chute 21 out of the cavity 19 thus ejecting the parachute from the cavity for quick and reliable deployment of the chute.

Figure 3:
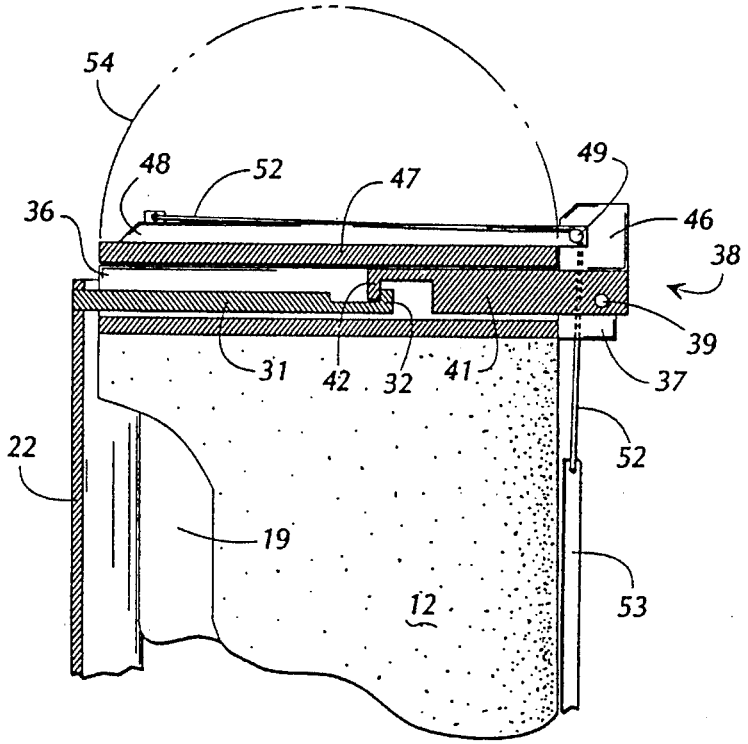
FIG. 3 is a sectional view of the nose end section of the rocket showing the chute release mechanism latched in place for flight and illustrating the relative placement and configuration of the various elements of the invention.

Referring to FIGS. 1 and 3, an elongated latch pin 31 is attached to and extends inwardly from the top portion of the hatch 22 toward the rocket body. The free end of the latch pin 31 is formed with an upwardly extending tang 32 that is used, as detailed below, to secure the latch pin 31 and thus the hatch 22 in a closed position during flight of the rocket.

A velocity dependant chute release mechanism 33 is adhesively fixed to the top of the rocket fuselage 12. The mechanism 33 is designed to release the latch pin 31 and thus open the hatch 22 to deploy the chute when the rocket slows to a predetermined, relatively small velocity. The release mechanism 33 comprises a base plate 34 formed with a diametrically extending groove 36. The groove 36 is sized and positioned to receive the latch pin 31 of the hatch 22 as the hatch is moved to its closed position covering the cavity 19. The position of the latch pin 31 relative to the groove 36 when the hatch is in its closed position is best illustrated in FIG. 3.

A spaced pair of hinge blocks 37 protrude from the base plate 34 on either side of the groove 36 opposite the end of the groove into which the latch pin 31 is received. A generally L-shaped latch keeper 38 is pivotally mounted between the hinge blocks 37 on a hinge pin 39. The latch keeper 38 has a first leg 41 that is sized and located to move into the groove 36 as the latch keeper pivots about hinge pin 39 inwardly toward the rocket. A downwardly extending tang 42 is formed at the end of the first leg 41 and is positioned to capture the upwardly extending tang 32 of the latch pin 31 when the hatch 22 is closed, as best illustrated in FIG. 3. In this way, when the latch keeper is fully pivoted to the closed orientation in which it is illustrated in FIG. 3, it functions to hold the latch pin 31 securely in place thus releasably latching the hatch 22 in its closed position. Naturally, when the latch keeper is hinged back in a clockwise direction as viewed in FIG. 1, the latch pin 31 is released permitting the hatch 22 to spring open under the influence of coil spring 28.

A disc-shaped flap 47 is fixed to a diametrically extending elongated hinge bar 48. One end of the hinge bar 48 extends beyond the periphery of the flap 47 and is disposed and pivotally secured on a hinge pin 49 between the spaced halves 44 and 46 of the latch keeper's second leg 43. With this configuration, the flap 47 is pivotable relative to the latch keeper about hinge pin 49 in the directions indicated by arrow 51. It can thus be seen that the latch keeper 43 is pivotable relative to the base plate 34 about hinge pin 39 and that the flap 47 is pivotable relative to the latch keeper 43 about hinge pin 49. Further, hinge pin 49 is inwardly displaced toward the rocket relative to the hinge pin 39. As discussed below, this offset double-hinged arrangement of the latch keeper and flap functions to insure that the hatch 22 remains securely closed and latched during rocket flight even if the flap 47 should flutter or otherwise move slightly about its hinged attachment.

A small cord or thread 52 is fixed at one end to the free end of the hinge bar 48 and extends therefrom to its other end, which is fixed to the end of a rubber band 53. The rubber band 53, in turn, extends downwardly toward the tail end of the rocket fuselage 12, where it is affixed to the fuselage by means of adhesive or another appropriate fastener. The cord 52 and the rubber band 53 have respective lengths that are chosen to insure that the rubber band and cord are slack when the flap and latch keeper are open as illustrated in FIG. 1, but become tight and tensioned when the latch keeper and flap are closed as illustrated in FIG. 3. Furthermore, the size of and thus tension provided by the rubber band is selected such that when the flap 47 is closed as shown in FIG. 3, the rubber band and cord tend to create a small torque or force on the flap 47 that acts to bias the flap toward its open position.

While a rubber band in conjunction with a cord has been illustrated in the preferred embodiment, it will be understood that the cord is not an essential element of the embodiment. The rubber band itself might be configured to extend the full distance spanned by the band and the cord, thus eliminating the necessity of the cord altogether.

Naturally, while a rubber band or rubber band and cord for biasing the flap has been illustrated, it will be understood by those of skill in the art that various other means, such as a spring, for biasing the flap toward its open position might also be employed with comparable results. For example, a spring might be used in place of the rubber band or a spring might be integrated into the offset double-hinged attachment of the latch keeper and flap to create a comparable biasing force. Therefore, the rubber band and cord of the illustrated embodiment should not be considered a limitation of the invention but only exemplary of one biasing methodology that is known to function adequately. Further, although not functionally required, in actual commercial use, a nose-cone 54 preferably is fixed to and covers the flap 47 to provide a pleasing and realistic aesthetic appearance for the nose section of the rocket 13.

FIG. 3 illustrates in cross-section the nose-cone of the rocket and the chute release mechanism as they appear with the parachute packed in the cavity 19 and the rocket ready for launch. Here, the hatch 22 is seen to be closed to cover the cavity 19 and confine the parachute therein. With the hatch closed, its latch pin 31 extends into the groove 36 of the base plate 34. The flap 47 is seen to be in its closed position with the cord 52 extending tautly from the end of the hinge bar 48 over the hinge pin 49 and thence downwardly to the end of the rubber band 53.

Since the hinge pin 49 is offset and inwardly displaced toward the rocket relative to the hinge pin 39, the downwardly directed tension provided by the rubber and on the hinge pin 49 creates torque on the latch keeper 38 that tends to pivot the latch keeper in a counter-clockwise direction about is hinge pin 39 and hold the latch keeper securely in its closed position. In addition, when the latch keeper 38 and the flap 47 are in their closed positions as shown in FIG. 3, the moment arm about hinge pin 49 is very small. In fact, the moment arm under these conditions is roughly equal to the distance between the center of hinge pin 49 and slightly beyond the radius of the hinge pin itself. Thus, the torque created by the rubber band about hinge pin 49 tending to open the flap is comparably small. This means that it is easy for the force of the wind to hold the flap down against the small torque when the rocket moves rapidly.

However, as the rocket slows to near zero velocity, the small torque about hinge pin 49 is sufficient to begin to open the flap against the force of the wind. As the flap moves, the rubber band and cord move outwardly away from hinge pins 49 and 39, as best illustrated in FIG. 1. Thus, the moment arm about hinge pin 49 and about hinge pin 39 increases as the cord moves away from the hinge pins. Therefore, as the flap opens, the torque and force tending to open it increases with the increasing length of the moment arm thus pulling the flap with increasingly greater force. When the flap ultimately engages the second leg 46 of the latch keeper, the torque is applied to the latch keeper itself tending to rotate it about hinge pin 39 to its open position. This torque, in conjunction with the force of any wind on the bottom of the flap, is more than sufficient to overcome any friction between the tangs 42 and 32 so that the latch pin 31 is released quickly and reliably. Accordingly, with the double hinged arrangement of the flap and latch keeper, once the flap begins to open, it flips open quickly to release the chute.

In the closed position of the latch keeper, the downwardly extending tang 42 captures the upwardly extending tang 32 of the latch pin 31 to latch and hold the hatch 22 securely in its closed position covering the cavity 19 as shown. It can thus be seen that even if the flap 47 flutters or even pivots a significant amount about hinge pin 49, the downward force of the rubber band 53 and cord 52 on the offset hinge pin 49 still continues to apply torque to the latch keeper 38 and thus maintains the latch keeper securely in its closed latched position.

Figure 4:
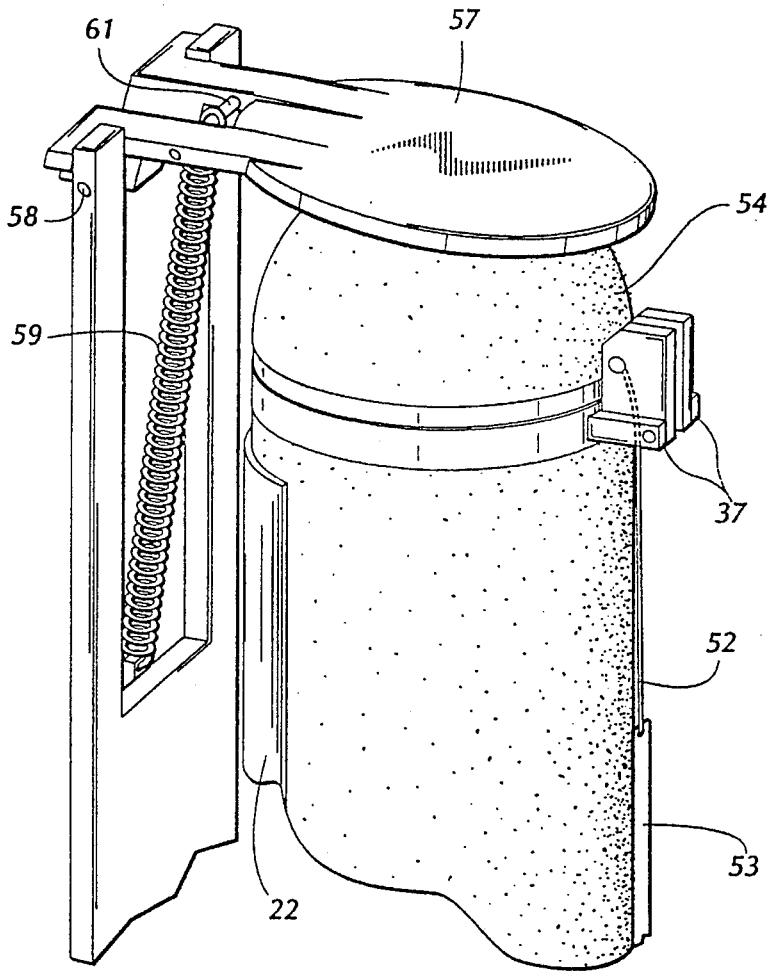
FIG. 4 is a perspective view showing that the nose-cone section of the toy rocket of this invention as it appears when closed, latched and mounted on a launcher for flight.

FIG. 4 illustrates the nose section of the rocket as it appears on the launcher prior to launch. The parachute has been folded and placed into the cavity, the hatch 22 closed over the cavity, and the latch keeper 38 and nose-cone 54 closed to latch and hold the hatch 22 in place. The launcher is provided with a paddle 57 that is hingedly mounted to the launcher structure by means of a hinge pin 58. A coil spring 59 is secured at one end to the launcher and is secured at is other end to a spring pin 61, which is inwardly displaced toward the rocket from the hinge pin 58. Thus, the spring 59 tends to hold the paddle 57 securely down against the top of the rocket's nose-cone 54 to prevent the nose-cone from being sprung to its open position prior to launch by the tension of the rubber band 53. Therefore, the paddle 57 and spring 59 function to hold the chute release mechanism closed while the rocket is on the launching pad.

When the rocket is launched, the paddle 57 is forced by the moving rocket to pivot rearwardly until its spring pin 61 rotates around and becomes rearwardly displaced relative to the hinge pin 58. At this point, the force of the spring 59 on the hinge pin 51 flips the paddle 57 backwardly and holds it open so that it does not interfere with movement of the rocket body as the rocket leaves the launcher.

In use of this invention, the rocket is launched into the air for flight by means of a compressed air or other launching mechanism. Immediately upon launch of the rocket, the paddle 57, which holds the nose-cone and latch down on the launcher, is pushed aside. The initial acceleration of launch acting on the rocket tends to hold the flap 47 and thus nose-cone 54 downwardly in the closed position illustrated in FIG. 4.

Once the rocket leaves the launcher, it moves through the air with substantial velocity. This results in the movement of wind past the body of the rocket as indicated by arrows 56 in FIG. 2. The wind impinging upon and compressing against the nose-cone 54 of the rocket 13 causes a force that acts downwardly against the nose-cone. This force tends to take over where the acceleration of launch left off to hold the flap 47 downwardly in its closed latching position as the rocket moves through the air. As the rocket slows on its upward trajectory, the force created by the wind gradually lessens until, near the apogee of the trajectory, the velocity of and force created by the wind becomes very small compared to its initial value.

As the force created by the moving wind on the nose-cone lessens, it ultimately reaches a magnitude that is smaller than the magnitude of the counteracting bias force created on the flap by the cord 52 and rubber band 53. At this point, the biasing force overcomes the force of the wind and causes the nose-cone and flap to pivot rearwardly about hinge pin 49 to their open position. As the flap pivots under the influence of the rubber band and cord, it ultimately engages the second leg 43 of the latch keeper 38. Further movement of the flap, then, draws the latch keeper back causing it to pivot rearwardly about latch pin 39 out of its closed position and toward its open position. The downwardly extending tang 42 of the latch keeper 38 is thus withdrawn from the groove 36. This releases the upwardly extending tang 32 on the latch pin 31 and thus frees the latch pin.

With its latch pin freed, the hatch 22 is sprung open under the influence of spring 28. As the hatch opens, it pulls the chute cords 29 and the parachute 21 out of the cavity 19 thus deploying the chute rapidly and reliably from the rocket. Once deployed, the chute eases the rocket back to earth in the usual way.

In practice, it is desirable that the parachute be deployed just prior to the apogee of the rocket's trajectory, regardless of the initial force with which the rocket is launched or the altitude to which it climbs. This insures that the rocket complete its entire flight before deployment of the chute and that the rocket is not already plummeting to earth when the chute is deployed. To facilitate this desired goal, the size and tension of the rubber band 53 is selected so that the biasing force imparted to the flap 47 by the rubber band and cord is of a predetermined small magnitude corresponding to the force of the wind on the nose-cone when the rocket is traveling at a relatively slow predetermined velocity just prior to apogee.

The biasing force on the flap provided by the rubber band is thus less than the force of the wind on the flap when the rocket moves at speeds greater than the predetermined velocity and is greater than the force of the wind when the rocket slows to a speed less that the predetermined velocity. It will therefore be seen that when the rocket slows to a speed less than the predetermined velocity, the biasing force overcomes the force of the wind causing the flap and latch keeper to spring back to release the hatch and deploy the chute. Since the release of the chute is dependent upon the velocity of the rocket, the chute is consistently deployed at roughly the same time just before the apogee of the rocket's trajectory. Further, the deployment time is independent of the force with which the rocket is launched or the altitude to which it climbs. In addition, deployment of the chute does not depend upon an explosive charge or other event that is tied to the burn-out of an engine but is a function only of the velocity of the rocket. Thus, previous problems associated with deploying chutes from powered model rockets are avoided altogether.

Figure 5:
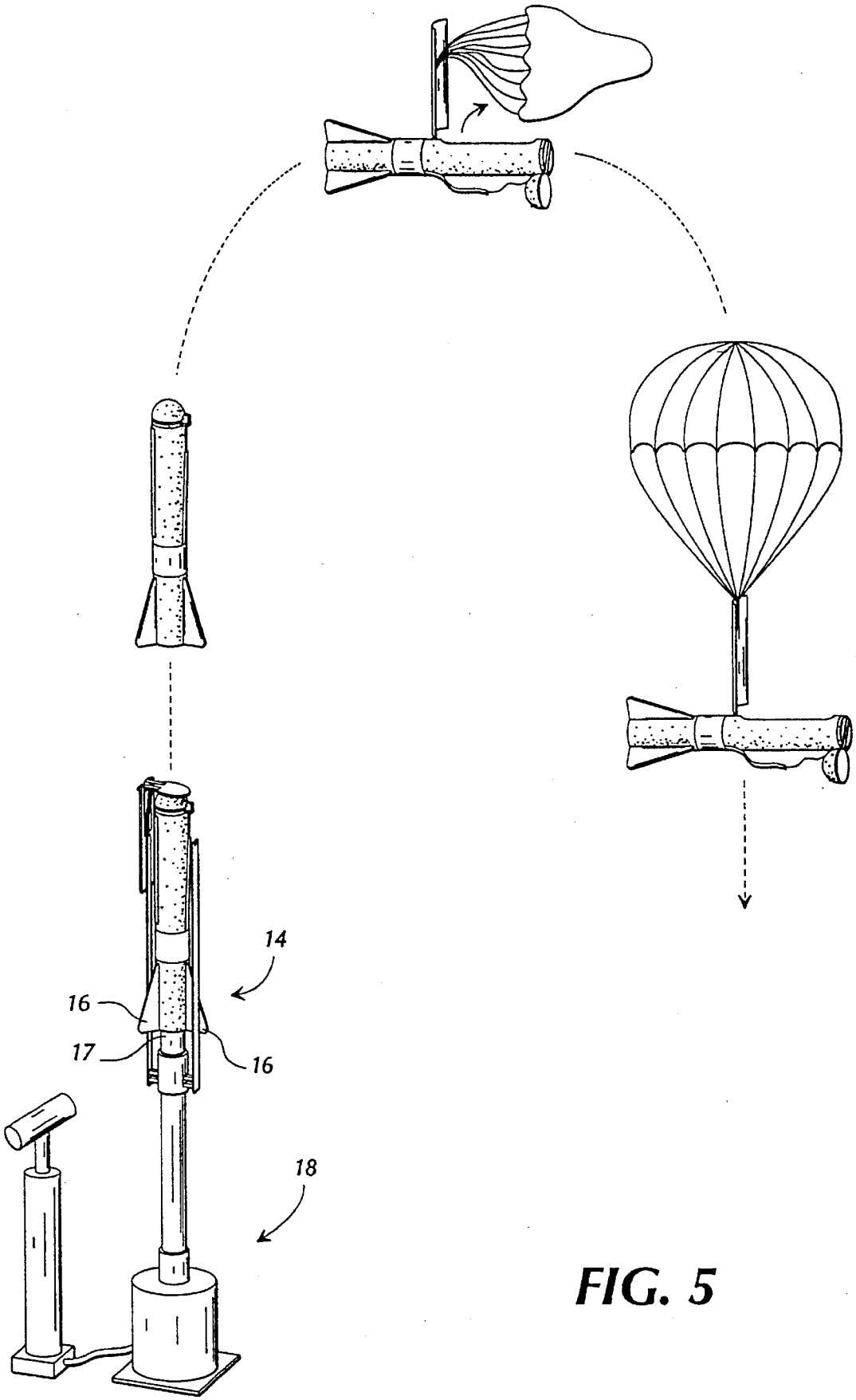
FIG. 5 is a sequence illustration shown stages of rocket flight from its pone position on the launcher to deployment of the chute at the apogee of the rocket's trajectory.

The just described cycle is illustrated in the sequence of FIG. 5. The first snapshot of the sequence shows the rocket mounted in a launch prone position on its launcher which, in this embodiment, comprises a compressed air launching mechanism. Once launched, the rocket travels upwardly at a relatively high speed and the wind generated by the rocket's motion holds the nose-cone down thus keeping the chute hatch latched and closed. However, as the rocket slows near its apogee, the force of the wind is overcome by the biasing force of the rubber band 53, and the nose-cone 54, flap 47, and latch keeper 38 are hinged backward. This releases the latch pin and opens the hatch 22. As the hatch 22 opens, its pulls the parachute cords and the parachute out of the cavity 19, which results in the deployment of the parachute. Once deployed, the parachute eases the rocket body back to the ground where it can be recovered.

Figure 6:
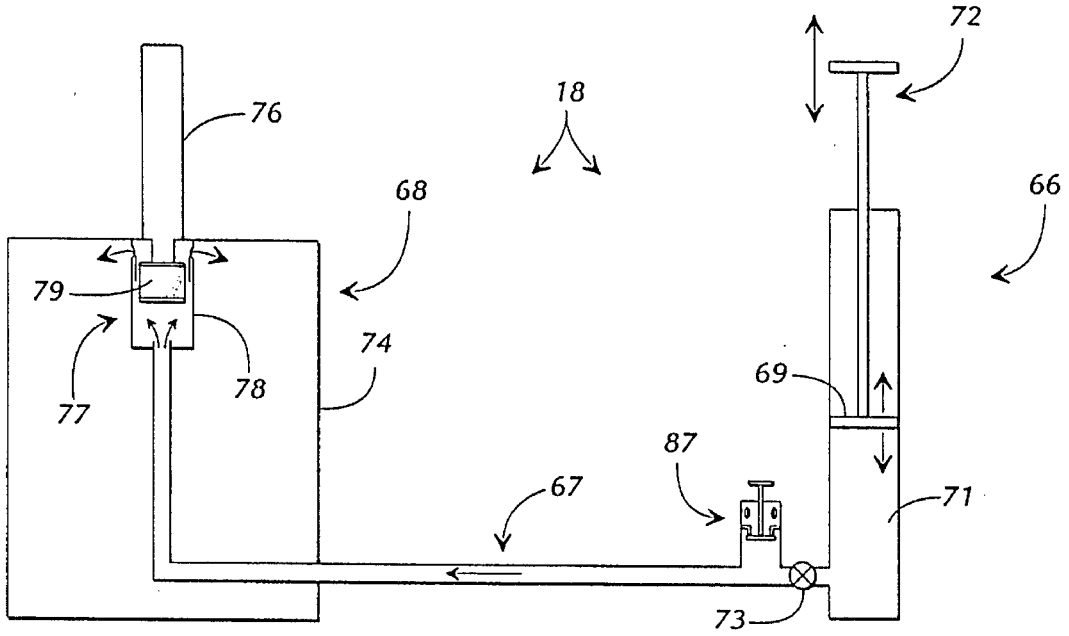
FIGS. 6 and 7 illustrate a preferred configuration and function of the pressurization and release valve mechanism for launching the rocket of this invention into the air.
Figure 7:
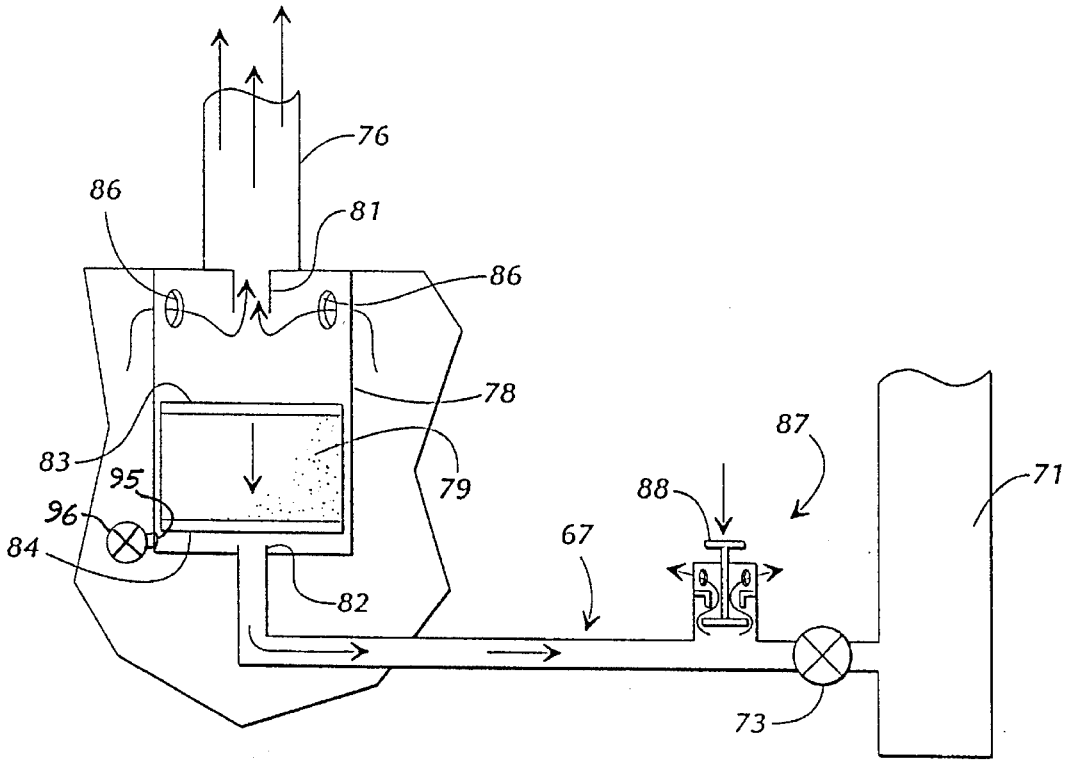

FIGS. 6 and 7 illustrate the mechanical functioning of the launcher 18 (FIG. 5). Specifically, FIG. 6 and 7 show in detail the pressurization and release mechanism employed to pressurize the launcher .and selectively release the pressure through the launch tube to catapult the rocket into the air.

Launcher 18 is seen to comprise a manual pump 66 coupled through a hose or tube 67 to the launcher base assembly 68. The pump 66 is of conventional construction and comprises a plunger 69 that can be reciprocated up and down within a pump cylinder 71 by means of a handle and push rod assembly 72. As the plunger 69 is manually reciprocated up and down within the cylinder 71, air is forced through the hose 67 to the launcher base assembly 68. A one-way check valve 73 prevents the movement of air through the hose 67 back to the pump 69.

The launcher base assembly 68 comprises a pressure chamber 74 from which a cylindrical hollow launch tube 76 upwardly extends. As seen in FIG. 5, in use, the toy rocket is slid over the launch tube 76 whereupon the release of pressure through the tube catapults the rocket into the air for flight.

A release valve assembly 77 is mounted within the pressure chamber 74 just beneath and communicating with the launch tube 76. As detailed below, the release valve assembly 77 functions to allow the pressure chamber 74 to be pressurized prior to launch of the rocket and also functions to release the pressure within the pressure chamber through the launch tube 76 when it is desired to launch the rocket. The release valve assembly 77 comprises a cylindrical manifold 78 that carries an internal cylindrical plunger 79. The plunger 79 fits relatively loosely within the manifold 78 such that it is free to slide up and down within the manifold.

The manifold 78 communicates at its upper end with the launch tube 76 and at its lower end with the hose 67, through which air is pumped by means of the pump 66. Seating lips 81 and 82 are formed about the ports that communicate with the launch tube 76 and hose 67 respectively. Seating gaskets 83 and 84 are provided on the upper and lower surfaces respectively of the plunger 79. With this configuration, it will be understood that when the plunger is slid upwardly to engage the lip 81, the gasket 83 seats and seals about the lip 81 to close off communication with the launch tube 76. Similarly, when the plunger is slid down within the manifold 78, the gasket 84 engages and seals about the lip 82 to close off communication with the hose 67. Finally, the manifold 78 is formed with a set of openings 86 disposed about its upper periphery. The openings 86 communicate with the interior of the pressure chamber 74 for purposes set forth in greater detail below.

A manually operable trigger valve assembly 87 is coupled in line with the hose 67. The trigger valve assembly 87 comprises a manually operable plunger 88 that can be depressed to release air pressure from within the hose 67 as best illustrated in FIG. 7.

The just described launcher functions as follows to catapult a rocket into the air for flight. First, the rocket is slid onto the launch tube 76 in its launch-prone position as shown in FIG. 5. The pump 66 is then operated causing air to be forced under pressure through the hose 67 and into the bottom of the manifold 78. The initial in-rush of air into the manifold drives the plunger 79 upwardly until it seats and seals against the lip 81 closing off communication with the launch tube 76. Air flowing through hose 67 then passes around the sides of the plunger 79 and exits the manifold through the openings 86. The exiting air creates pressure within the pressure chamber 74 and also within the manifold 78. This increased pressure, in turn, continues to hold the plunger 79 up against the lip 81. Continued operation of the pump 66, then, further pressurizes the chamber 74 and the pump is operated until the desired pressure level is achieved.

As an alternative to a loose fitting plunger with pressurized air passing about the sides of the plunger to pressurize the chamber through openings 86, the plunger could fit snugly and sealingly within the manifold to inhibit air passage around its sides. In such an embodiment, a second opening might be formed in the manifold adjacent the second end thereof with the second opening communicating with the interior of the chamber through a one-way valve assembly as seen at 95 and 96. With such an embodiment, compressed air supplied through the pressure hose 67 would pass through the second opening to pressurize the chamber rather than passing around the plunger and through the opening 86.

With the pressure chamber 74 pressurized, the toy rocket can be launched into the air for flight by depressing the plunger 88 of the trigger valve assembly 87. Specifically, as best seen in FIG. 7, when the plunger 88 is depressed, pressure within the hose 67 is released and allowed to escape through openings in the trigger valve assembly. This reduces the pressure within the hose 67 and, in turn, rapidly reduces the pressure in the lower portion of the manifold 78 beneath the plunger 79. As a consequence, pressure from within the pressure chamber 74 presses downwardly on the top of the plunger 79 causing the plunger 79 to slide down the manifold to engage and seat against the lip 82 as seen in FIG. 7. When the plunger 79 moves downwardly in this fashion, all of the pressurized air within the pressure chamber 74 is free to move through the openings 86 and into the launch tube 76. In practice, the openings 86 are sized to allow an extremely rapid release of pressured air through the launch tube in a sudden burst. The burst of pressurized air through the launch tube 76, in turn, catapults the toy rocket into the air for flight as illustrated in FIG. 5, The just described pressurization and release mechanism has proven to be reliable and efficient both in construction and in operation. Furthermore, with the illustrated assembly, the release trigger for launching the rocket can be located on or adjacent to the pressurization pump, which, in turn, can be located any desired distance from the actual launcher base assembly 68 by means of an appropriate length of hose 67. Thus, the operator can be located at some distance from the launcher and can both pressurize the launcher and launch the rocket from the same location. Also, only one connecting hose 67 is required between the pump and the launcher rather than a pressurization hose and a trigger hose as has sometimes been required in the prior art.

Figure 10:
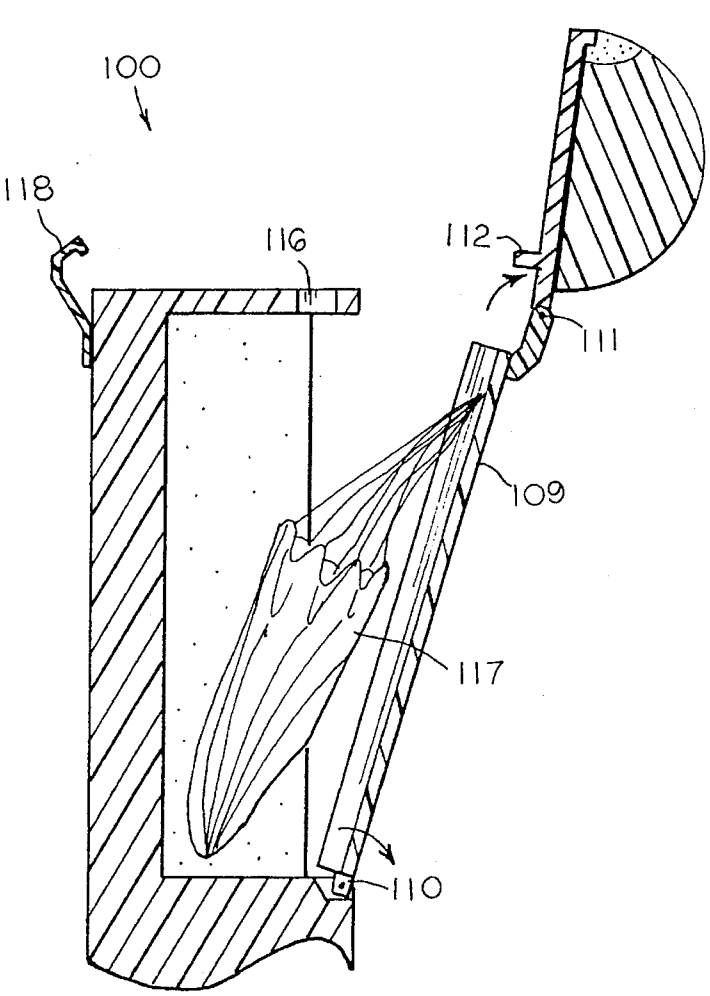
FIGS. 8–10 are a sequence of views showing a portion of a rocket in another preferred form, which show, in sequence, the rocket in a static condition prior to launch, in an initial in-flight condition and in a hatch opened condition.
Figure 9:
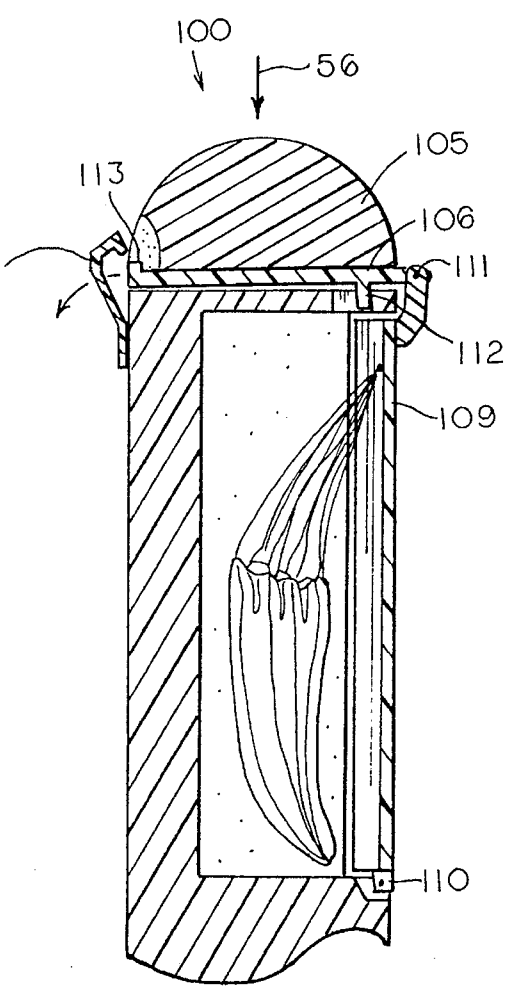
Figure 8:
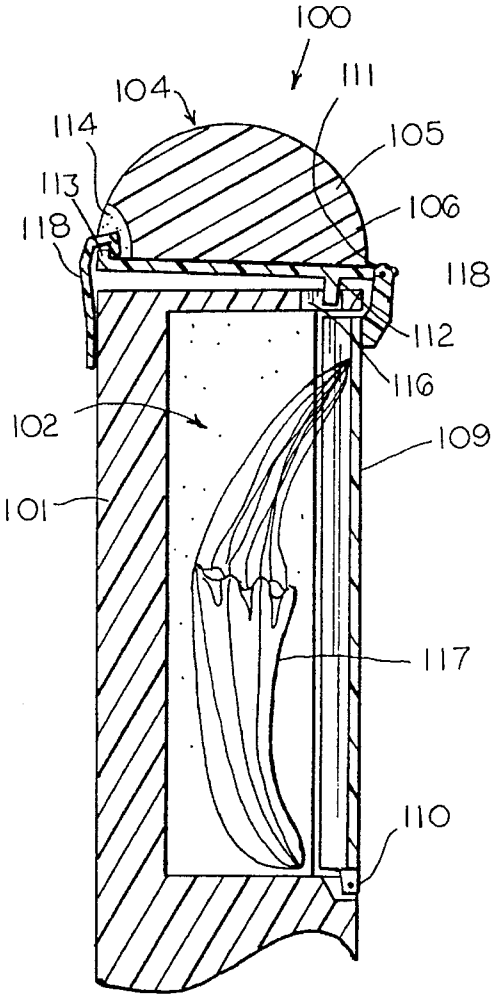

Referring next to FIGS. 8–10, there is shown a rocket 100 in an alternative embodiment. Here, the rocket 100 has a plastic fuselage or body 101 having a cavity or bay 102 therein, and a nose section 104. The nose section 104 has a nose-cone 105 and a flap 106 integral with the nose-cone 105.

A hatch 109 is pivotally mounted at a lower end thereof to the body 101 by a spring biased hinge 110 so as to pivot the hatch between a bay closed position shown in FIG. 8 and a bay open position shown in FIG. 10. The biasing force of the spring biased hinge 110 moves the hatch 109 towards its bay open position. The hatch 109 is pivotally coupled at an upper end thereof to flap 106 by another spring biased hinge 111. The biasing force of spring biased hinge 111 moves the flap upwards and outwards with respect to the rocket body shown in FIG. 8. The flap 106 has a tang or catch 112 extending from a bottom surface of the flap and a lip 113 extending from a top surface of the flap which is accessible through a recess 114 in the nose cone 105. Tang 112 is configured to be received in a tang recess 116 extending into the top of the rocket body 101.

The rocket 100 also has a parachute 117 secured to the hatch 109 and a resilient hook-shaped catch 118 extending from the top edge of the rocket body 101. Catch 118 is configured to move between a biased, latched position engaging flap lip 113, as shown in FIG. 8, and an natural, unlatched position disengaging flap lip 113, as shown in FIGS. 9 and 10.

In use, the rocket 100 is positioned upon the launcher 18 with the parachute 117 stowed within bay 102, as previously described with the exception of the presence and need for paddle 57 and its related components. With the rocket in a static position as shown in FIG. 8, the catch 118 captures the lip 113 of nose section flap 106 to maintain the position of the nose cone. The flap 106 is spring biased by hinge 111 in an upwards direction against catch 118 to ensure the maintenance of the static, latched position of the catch 118. The positioning of flap tang 112 within recess 116 prevents the hatch 109 from being spring biased to its bay open position by hinge 110.

As shown in FIG. 9, upon initial launch of the rocket 100 the inertia of the nose cone 105 and flap 106 and/or the initial wind resistance upon the nose section causes the flap 106 to move downward. This downward movement of the flap moves the flap lip 113 to a position wherein the catch 118 releases or disengages the flap lip 113. As the rocket moves through the air the wind resistance of the nose cone 105 maintains the flap 106 in a position against rocket body 101 with tang 112 captured within recess 116, i.e. the velocity of the rocket creates an airstream against the nose section which acts as an air baffle that maintains the downward position of the flap so as to maintain the hatch in its bay closed position. It should be understood that the biasing force of hinge 111 is initially in a direction generally opposite to the force of the wind.

As shown in FIG. 10, once the rocket has reached its apogee the force of the wind upon the nose section 104 becomes less than the biasing force of spring biased hinge 111. As such, hinge 111 moves flap 106 upwards and outwards thus causing the tang 112 to be moved from within recess 116. The removal of the tang allows the biasing force of spring biased hinge 110 to move the hatch to its bay opened position so as to pull the parachute 117 from within the bay 102.

Figure 13:
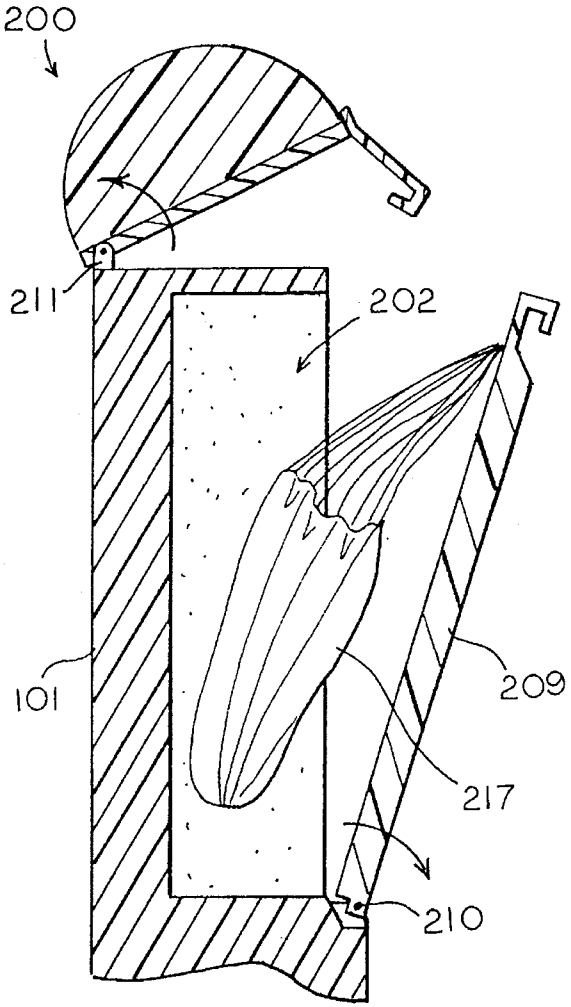
FIGS. 11–13 are a sequence of views showing a portion of a rocket in another preferred form, which show, in sequence, the rocket in a static condition prior to launch, in an initial in-flight condition and in a hatch opened condition.
Figure 12:
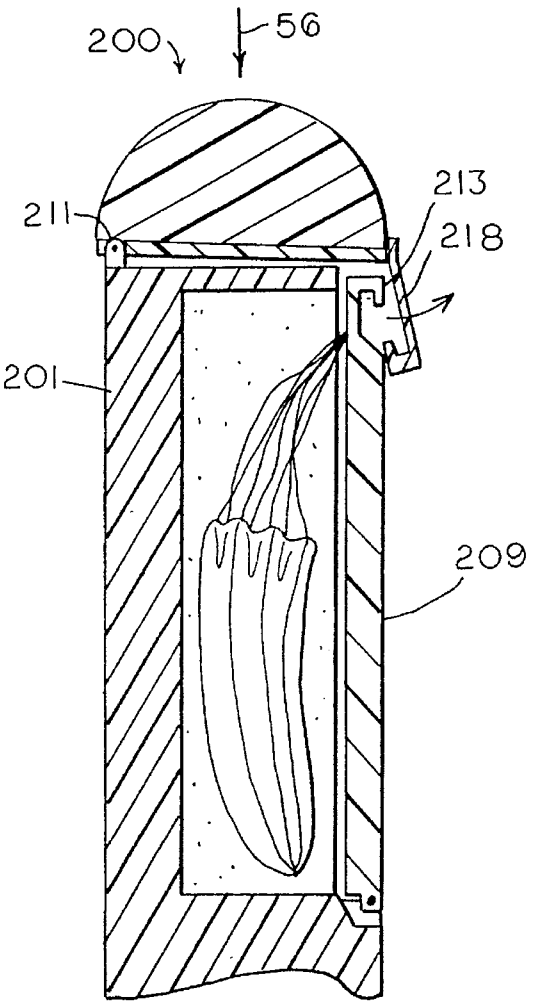
Figure 11:
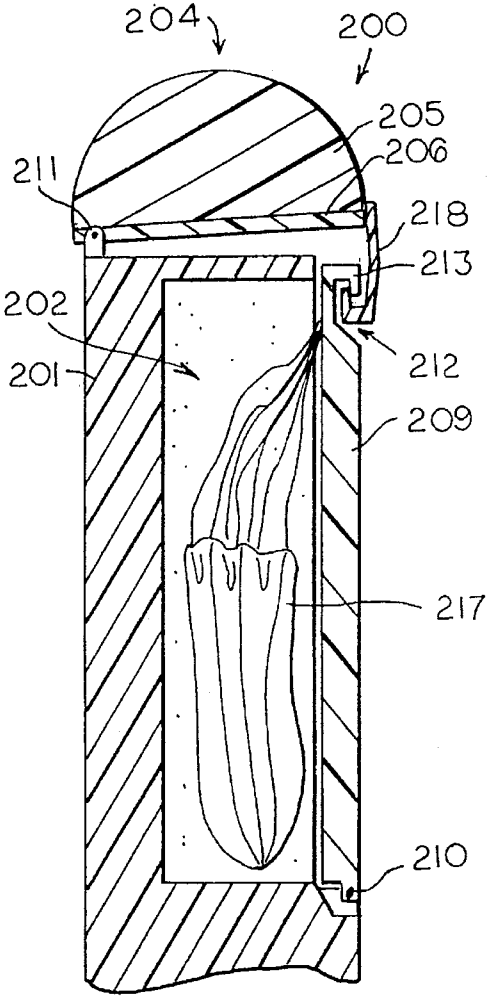

Referring next to FIGS. 11–13, there is shown a rocket 200 in another alternative embodiment. Here, the rocket 200 has a plastic fuselage or body 201 having a cavity or bay 202 therein, and a nose section 204. The nose section 204 has a nose-cone 205 and a flap 206 integral with the nose-cone 205.

A hatch 209 is pivotally mounted at a lower end thereof to the body 201 by a spring biased hinge 210 so as to pivot the hatch between a bay closed position shown in FIG. 11 and a bay open position shown in FIG. 13. The biasing force of the spring biased hinge 210 moves the hatch 209 towards its bay open position. The rocket body 201 is pivotally coupled at an upper end thereof to nose section flap 206 by another spring biased hinge 211. The biasing force of spring biased hinge 211 moves the flap upwards and outwards with respect to the rocket body shown in FIG. 11. The hatch 209 has an L-shaped catch recess 212 forming a tang 213. The rocket 200 also has a parachute 217 secured to the hatch 209 and a resilient hook-shaped catch 218 extending from the bottom edge of the nose section 104. Catch 218 is configured to move between a biased, latched position partially within the catch recess 212 of the hatch 209 for engagement with tang 213, as shown in FIG. 11, and an natural, unlatched position disengaging tang 213, as shown in FIGS. 12 and 13.

In use, the rocket 200 is positioned upon the launcher 18 with the parachute 217 stowed within bay 202, as previously described with the exception of the presence and need for paddle 57 and its related components. With the rocket in a static position as shown in FIG. 11, the catch 218 captures the tang 113 of hatch 109 to maintain the nose section in a launched position. The flap 206 is spring biased by hinge 211 in an upwards direction to ensure that catch 218 and thus the nose section is maintained in a latched position. This positioning of catch 218 prevents the hatch 209 from being spring biased to its bay open position by hinge 210.

As shown in FIG. 12, upon initial launch of the rocket 200 the inertia of the nose section 204 and/or the initial wind resistance 56 upon the nose section causes the flap 206 to move downward. This downward movement of the flap moves the catch 218 to a position wherein it releases or disengages from hatch tang 113. As the rocket moves through the air the wind resistance of the nose section 204 maintains the flap 206 in a position against rocket body 201 with the catch 218 in a positioned against the hatch to prevent the hatch 209 from being biased to its bay opened position, i.e. the velocity of the rocket creates an airstream against the nose section which acts as an air baffle that maintains the downward position of the flap so as to maintain the hatch in its bay closed position. It should be understood that the biasing force of hinge 211 is initially in a direction generally opposite to the force of the wind.

As shown in FIG. 13, once the rocket has reached its apogee the force of the wind upon the nose section 204 becomes less than the biasing force of spring biased hinge 211. As such, hinge 211 moves flap 206 upwards and outwards thus causing the catch 218 to be moved from adjacent the hatch 209. The displacement of the catch allows the biasing force of spring biased hinge 210 to move the hatch to its bay opened position so as to pull the parachute 217 from within the bay 202.

It should be understood that in the just describe embodiment the positioning of the catch 218 and recess 212 may be reversed to establish the same results, i.e. alternatively the nose section has the recess and the hatch includes a catch adapted to mate with the recess.

Figure 16:
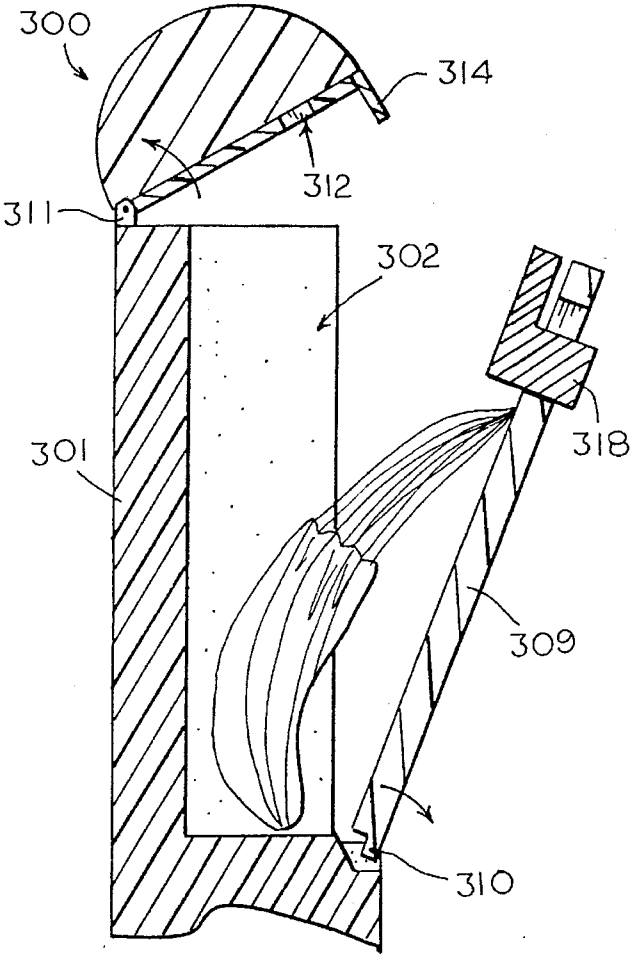
FIGS. 14–16 are a sequence of views showing a portion of a rocket in yet another preferred form, which show, in sequence, the rocket in a static condition prior to launch, in an initial in-flight condition and in a hatch opened condition.
Figure 15:
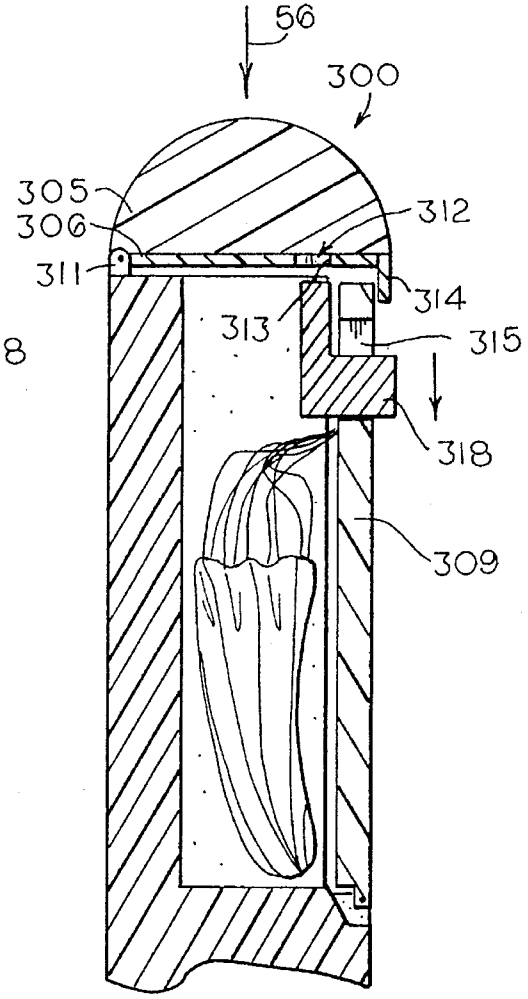
Figure 14:
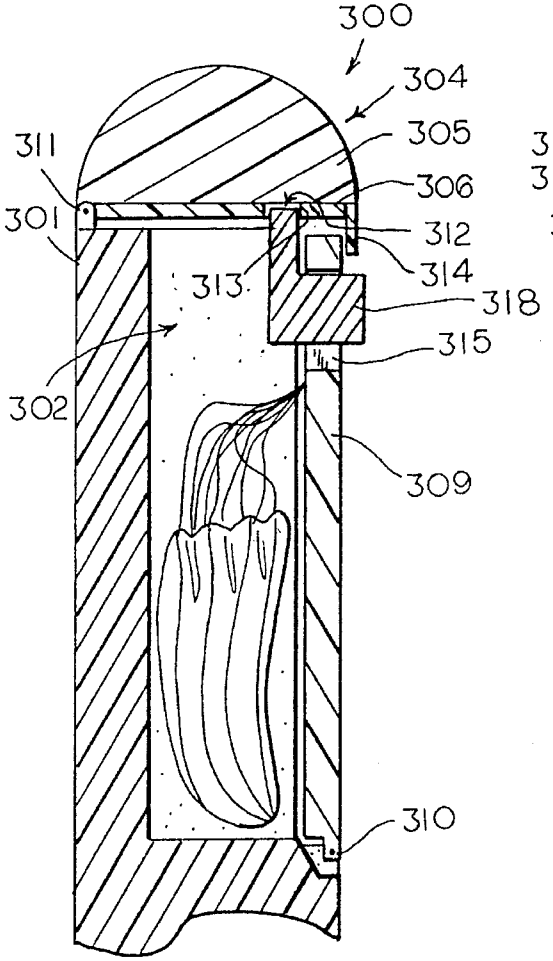

Referring next to FIGS. 14–16, there is shown a rocket 300 in yet another alternative embodiment. Here, the rocket 300 has a plastic fuselage or body 301 having a cavity or bay 302 therein, and a nose section 304. The nose section 304 has a nose-cone 305 and a flap 306 integral with the nose-cone 305.

A hatch 309 is pivotally mounted at a lower end thereof to the body 301 by a spring biased hinge 310 so as to pivot the hatch between a bay closed position shown in FIG. 14 and a bay open position shown in FIG. 16. The biasing force of the spring biased hinge 310 moves the hatch 309 towards its bay open position. The nose section flap 306 is pivotally coupled to an upper end of body 301 by another spring biased hinge 311. The biasing force of spring biased hinge 311 moves the flap upwards and outwards with respect to the rocket body shown in FIG. 14. The flap 306 has a recess 312 therein which forms a catch wall 313 and a tang or stop 314 extending downward from flap 306. Recess 312 is configured to be received in a catch 318 slidably along hatch 309. The hatch 309 has a slot 315 therethrough in which is slidably mounted a catch 318 for movement between a frictionally held, latched position engaging flap catch wall 313, as shown in FIG. 14, and an unlatched position disengaging the flap catch wall, as shown in FIGS. 15 and 16. The rocket 300 also has a parachute 317 secured to the hatch 309.

In use, the rocket 300 is positioned upon the launcher 18 with the parachute 317 stowed within bay 302, as previously described with the exception of the presence and need for paddle 57 and its related components. With the rocket in a static position as shown in FIG. 14, the catch 318 frictionally engages catch wall 313 of nose section flap 306 to prevent the upwards movement of the nose section by the spring biasing force of hinge 311 and to ensure the maintenance of the latched position of the catch 318 to maintain the position of the nose cone. The positioning of nose section tang 314 in abutment with hatch 309 prevents the hatch from being spring biased to its bay open position by hinge 310.

As shown in FIG. 15, upon initial launch of the rocket 300 the inertia of the catch 318 and/or the initial wind resistance 56 upon the catch causes it to move downward along hatch slot 315 to a position wherein the catch 318 releases or disengages the nose section catch wall 313. As the rocket moves through the air the wind resistance of the nose section 304 maintains the flap 306 in a position against rocket body 301 with tang 314 in abutment with hatch 309 to prevent the hatch from moving to its bay open position, i.e. the velocity of the rocket creates an airstream against the nose section which acts as an air baffle which maintains the downward position of the nose section so as to maintain the hatch in its bay closed position. It should be understood that the biasing force of hinge 311 is initially in a direction generally opposite to the force of the wind.

As shown in FIG. 16, once the rocket has reached its apogee the force of the wind upon the nose section 304 becomes less than the biasing force of spring biased hinge 311. As such, hinge 311 moves flap 306 upwards and outwards thus causing the tang 314 to be moved from abutment with hatch 309. The displacement of the tang allows the biasing force of spring biased hinge 310 to move the hatch to its bay opened position so as to pull the parachute 317 from within the bay 302.

It should be understood that the nose section of the previously described embodiments may, or course, be of unitary construction rather than the combination flap and nose cone just described.

It thus is seen that a rocket in now provided which includes a velocity dependent chute release that effectively deploys a parachute at the apogee of the flight of the rocket. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A rocket comprising:

a body having a forward end relative to the direction of initial rocket propulsion and a bay;

a hatch movably mounted to said body for movement between a bay closed and opened positions;

a parachute stowed within said bay;

a first catch mounted adjacent a forward end of said body, and a nose cone coupled to said hatch in latched engagement with said first catch in a static, prelaunched condition and in unlatched disengagement with said first catch in an inertially launched condition during initial rocket propulsion, whereby with the initial forward movement or the rocket the inertia of the nose cone causes it to move to its unlatched condition and whereby the velocity of the rocket creates an airstream against the nose cone which maintains the hatch in a closed position by generating an air resistance force on the nose cone that is greater than the biasing force of the biasing means, and whereby the velocity of the rocket below a level sufficient for the wind resistance force to overcome the biasing force of the biasing means causes the hatch to move from its bay closed position to its bay opened position to release the parachute.

2. The rocket of claim 1 wherein said nose cone is mounted to said hatch.

3. The rocket of claim 2 wherein said nose cone is pivotably mounted to said hatch.

4. The rocket of claim 1 wherein said nose cone is mounted to said body.

5. The rocket of claim 4 wherein said nose cone is pivotably mounted to said body.

6. The rocket of claim 1 wherein said biasing means is a spring.

7. The rocket of claim 3 further comprising second biasing means for biasing said nose cone in a direction generally opposite to the inertia force of said nose cone created upon initial forward movement of the rocket.

8. The rocket of claim 5 further comprising second biasing means for biasing said nose cone in a direction generally opposite to the inertia force of said nose cone created upon initial forward movement of the rocket.

9. The rocket of claim 7 further comprising a second catch extending from said nose cone adapted to engage said body.

10. The rocket of claim 1 further comprising a second catch extending from said nose cone adapted to engage said hatch.

11. The rocket of claim 1 wherein said catch is slidably mounted to said hatch.

12. A rocket comprising:

a body having a bay;

a hatch movably mounted to said body for movement between a bay closed and opened positions;

first biasing means for biasing said hatch towards said bay opened position;

a parachute stowed within said bay;

latch means for latching said hatch in its bay closed position and for unlatching said hatch for movement to its bay opened position;

means for unlatching said latch means in response to acceleration of said body to a high velocity through air, and air baffle means for holding said unlatched hatch in said bay closed position until said rocket decelerates in the air to a low velocity.

13. The rocket of claim 12 wherein said air baffle means comprises a nose cone mounted to said hatch.

14. The rocket of claim 13 wherein said nose cone is pivotably mounted to said hatch.

15. The rocket of claim 12 wherein said air baffle comprises a nose cone mounted to said body.

16. The rocket of claim 15 wherein said nose cone is pivotably mounted to said body.

17. The rocket of claim 16 wherein said latch means comprises a catch.

18. The rocket of claim 14 wherein said latch means comprises a catch.

19. The rocket of claim 12 wherein said first biasing means is a spring.

20. The rocket of claim 12 wherein said latch means comprises a catch.

21. The rocket of claim 18 wherein said means for unlatching comprises second biasing means for biasing said nose cone in a direction opposite to the forward initial acceleration of the rocket.

22. The rocket of claim 17 wherein said means for unlatching comprises second biasing means for biasing said nose cone in a direction opposite to the forward initial acceleration of the rocket.

23. The rocket of claim 22 wherein said air baffle means further comprises a second catch extending from said nose cone adapted to engage said hatch.

24. The rocket of claim 21 wherein said air baffle means further comprises a second catch extending from said nose cone adapted to engage said body.

25. The rocket of claim 20 wherein said catch is slidably mounted to said hatch.

26. A rocket comprising:

a body having a bay, a forward end and a tail end;

a hatch mounted to said body for movement between a bay open position and a bay closed position;

biasing means for biasing said hatch towards said bay open position;

a parachute stowed within said bay;

a catch mounted adjacent said forward end of said body;

a nose cone mounted adjacent said forward end of said body, said nose cone being movable between a first, static position engaging said catch and a second position disengaging said catch as a result of the force of air resistance against said nose cone upon initial forward movement of said rocket, whereby with the initial forward movement of the rocket the air resistance upon the nose cone causes it to move to its second position disengaging the catch and whereby the velocity of the rocket creates an airstream against the nose cone which maintains the hatch in a closed position by creating a force greater and generally opposite to that of the biasing force of the biasing means, and whereby the velocity of the rocket below a level sufficient to overcome the biasing force of the biasing means causes the hatch to move towards its bay open position to release the parachute.

27. The rocket of claim 26 wherein said nose cone is mounted to said hatch.

28. The rocket of claim 27 wherein said nose cone is pivotably mounted to said hatch.

29. The rocket of claim 26 wherein said nose cone is mounted to said body.

30. The rocket of claim 29 wherein said nose cone is pivotably mounted to said body.

31. The rocket of claim 26 wherein said biasing means is a spring.

32. The rocket of claim 28 further comprising second biasing means for biasing said nose cone in a direction opposite to the force of the air resistance against said nose cone upon initial forward movement of the rocket.

33. The rocket of claim 30 further comprising second biasing means for biasing said nose cone in a direction opposite to the force of the air resistance against said nose cone upon initial forward movement of the rocket.

34. The rocket of claim 32 further comprising a second catch extending from said nose cone adapted to engage said body.

35. The rocket of claim 33 further comprising a second catch extending from said nose cone adapted to engage said hatch.

* * * * *